United States Patent [19]

Saliba

[11] Patent Number: 4,817,769

[45] Date of Patent: Apr. 4, 1989

[54] HASP LOCK, ZIPPER AND COVER ASSEMBLY FOR PORTFOLIO

[76] Inventor: Frank Saliba, 115 W. 30th St., New York, N.Y. 10001

[21] Appl. No.: 130,218

[22] Filed: Dec. 8, 1987

Related U.S. Application Data

[63] Continuation of Ser. No. 859,484, May 5, 1986, abandoned.

[51] Int. Cl.[4] ..... A45C 3/02; A45C 13/10; A45C 13/36

[52] U.S. Cl. ..... 190/18 R; 190/120; 190/124; 190/126; 190/900; 190/903; 24/432; 70/68; 383/97

[58] Field of Search ..... 190/100, 101, 40, 18 R, 190/113, 119, 120, 124, 125, 127, 900, 903; 150/52 B; 383/14, 97, 110; 112/265.2; 24/387, 389, 432; 70/68

[56] References Cited

U.S. PATENT DOCUMENTS

| | | | |
|---|---|---|---|
| 1,680,652 | 8/1928 | Walinsky | 190/120 X |
| 1,843,619 | 2/1932 | Norris | 150/52 R |
| 1,859,970 | 5/1932 | Kaufmann | 190/119 |
| 1,893,420 | 1/1933 | Lacher | 190/903 X |
| 1,930,659 | 10/1933 | Purdy | 383/61 X |
| 1,934,360 | 11/1933 | Laufman | 190/903 X |
| 1,984,122 | 12/1934 | Felmann | 150/130 |
| 2,053,630 | 9/1936 | Plotkin | 383/97 X |
| 2,064,180 | 12/1936 | Rocke | 24/389 |
| 2,096,895 | 10/1937 | Halpin | 383/97 X |
| 2,113,921 | 4/1938 | Mashek | 190/125 |
| 2,288,105 | 6/1942 | Plotkin | 383/97 X |
| 2,318,563 | 5/1943 | Smith | 383/14 X |
| 2,464,350 | 3/1949 | Schmidt | 383/97 X |
| 2,606,588 | 8/1952 | Kaufman | 150/129 X |
| 2,779,371 | 1/1957 | Klehr | 190/900 X |
| 2,921,615 | 1/1960 | Kilik | 190/900 X |
| 3,143,778 | 8/1964 | Abraham | 24/432 |
| 3,161,271 | 12/1964 | O'Neil | 190/120 X |
| 3,263,238 | 8/1966 | Waldes | 112/265.2 X |
| 3,325,869 | 6/1967 | Younger | 24/387 |
| 3,547,079 | 12/1970 | Bassett | 383/41 X |
| 3,741,355 | 6/1973 | Slan | 190/127 X |
| 3,901,360 | 8/1975 | Cook | 150/52 R X |
| 3,960,300 | 6/1976 | Dickler | 150/52 R X |
| 3,973,419 | 8/1976 | Atkinson | 70/68 |
| 4,045,117 | 8/1977 | Lerner | 150/52 J X |
| 4,066,195 | 6/1978 | Dickler | 224/153 |
| 4,257,463 | 3/1981 | Monaco | 383/97 X |

FOREIGN PATENT DOCUMENTS

| | | | |
|---|---|---|---|
| 2438523 | 2/1976 | Fed. Rep. of Germany | 150/52 R |
| 626717 | 12/1927 | France | 190/119 |

*Primary Examiner*—Sue A. Weaver
*Attorney, Agent, or Firm*—A. A. Saffitz

[57] ABSTRACT

The invention relates to a novel covered zipper assembly for the top of a portfolio with two heavy duty magnetic catches, one at each end thereof and being secured between the portfolio panels at the top to hide the zipper from view. A combination lock cooperating with a hasp protrudes from one end to be inserted into a catch portion at the side of the portfolio whereby the pull tab of the zipper can be grasped to slide open the top of the portfolio. Lock means, preferably combination lock means, are provided at the hasp. The covering is preferably constructed of high grade leather which is fastened by sewing to the other side panels of the portfolio at the top inner edges thereof. Easy access to the top of the portfolio for opening is not readily suggested by observing from the top because the cover assembly hides the zipper from view. In a preferred embodiment the inner walls of the outer side panels are lined with high grade pigskin having a suede texture and the other walls of the side panels which consist of high grade tanned cowhide are laminated at the edges to the inner walls and are provided with an inner cushioning layer of synthetic flexible foam, such as polyurethane foam which plumps the outer panels to enhance the softness of these panels.

6 Claims, 2 Drawing Sheets

7
9
11
13
15
16
17
19
21
23
25
27
29
29a
31
31a
33
33b
34
35
35a
37
38
39

HASP LOCK, ZIPPER AND COVER ASSEMBLY FOR PORTFOLIO

This is a continuation of application Ser. No. 06/859,484, filed May 5, 1986.

CROSS-REFERENCE TO RELATED APPLICATION

Reference is made to my copending application entitled "Handle and Panel Assembly for Portfolio", Ser. No. 859,483 filed on the same date as the present application now U.S. Pat. No. 4,714,143, granted Dec. 22, 1987.

BACKGROUND OF THE INVENTION

1. Field of the Invention

The invention is in the field of top opening portfolios, preferably those having retractable handles and having a body which is constructed of high grade long wearing leather and is preferably lined with a suitable flexible leather lining, such leather portfolio being recognized as being long lasting and durable.

The invention is also in the field of unitary covered zipper and lock assemblies which is especially adapted for improving the security of brief cases and leather portfolios in which the sole top opening means is a zipper means which requires the use of a lock to discourage unauthorized entry into a central security compartment.

2. Description of the Prior Art

The concept of covering a lock to protect it has long been recognized as a desirable security precaution and one example is shown in Norris, U.S. Pat. No. 1,843,619. Norris discloses a jacket of insulating material for a safe to prevent a burglar from using a blowtorch to open the safe but which leaves space for access to the combination so an authorized person may operate the combination lock.

It is common practice to provide a protecting lock for luggage and positioning it directly below the handle to thereby provide secured luggage opened only by the owner. The handle construction for the luggage is reinforced at the ends of the handle to accommodate heavy loads and so that it does not easily pull away from the top of the luggage. This handle problem is not encountered in portfolios which have insufficient capacity for heavy loads.

In O'Neil, U.S. Pat. No. 3,161,271, a strap is provided which is intended to prevent the clasp from opening due to accidental manipulation near the handle. However, the strap for the clasp placed at the top of a side opening piece of luggage is not comparable to a covered slide fastener which maintains the luggage in closed condition.

In U.S. Pat. No. 4,066,195 to Dickler, there is shown tamper-proof backpack luggage made of plastic or molded fiberboard having a combination lock which is provided under the handle and further having straps fastened to the underside to permit the luggage to be carried on the back of the traveler. Dickler, U.S. Pat. No. 3,960,300 also shows a combination lock with a spring loaded latch similar to Dickler U.S. Pat. No. 4,066,195. The luggage is opened from the side while a portfolio is opened from the top.

As defined in both Merriam Webster 1974 Dictionary published by Pocket Books, New York, and Webster's Seventh New Collegiate Dictionary, 1967, published by G. & C. Merriam Co., Springfield, Mssachusetts, "a portfolio consists of a potable case for paper and drawings."

Modern portfolios which are of the type which are provided with retractable handles, obviously can not be provided with a lock below a retractable handle as shown in the Dickler patent.

A covering has been provided for side opening luggage as shown in Cook, U.S. Pat. No. 3,901,360 wherein a protector portion is provided for only a part of the zipper at the side of the luggage but the entire zipper is not concealed.

Tapes or straps which help in opening a zipper section of a case are commonly found in camera cases and an example of such a strap is shown in Lerner, U.S. Pat. No. 4,045,117. Still another example of a tape for a zipper is shown in a pet bag, Bassett U.S. Pat. No. 3,547,079.

Covered zippers are widely used in garments, as for example as shown in Roche, U.S. Pat. No. 2,064,180 and in Abraham U.S. Pat. No. 3,143,778. These covered zippers are intended to bring the flexible fabric from each side of the fabric panel in abutting edge relation to obstruct the view of the zipper from the front or top. Such a split cover is shown in the Roche U.S. Pat. No. 2,064,180 and this is the type of cover which is widely used for pants. The Abraham fastener shows various embodiments of a covered slide fastener which are more sophisticated and for a double line of stitching at the abutting end. In both types of covered zippers, the most common complaint is that the cover gets caught at an edge in the zipper and cannot be easily separated.

Still another type of covering for a slide fastener is shown in a vacuum cleaner dust bag as described in the Purdy Patent, U.S. Pat. No. 1,930,659.

In the Purdy patent the edge of the covering can be caught in the zipper in just the same fashion as with the zippers used in clothing, e.g. men's pants, ladies dresses and the like.

This inherent characteristic of zippers covered with flexible cloth panels meeting at a common edge over the slide fastener joining line may have prevented progress in creating new forms of construction for portfolios designed to enhance the security of the contents by hiding the opening mechanisms from the view of unauthorized persons, and by providing security locking means which deter unauthorized entry.

OBJECTS OF THE INVENTION

It is an object of the invention to provide a novel opening assembly means to obscure the slide fastener opening at the top of the portfolio and to provide in the same covering assembly means, lock securing means which are partially obscured and a hasp closing and opening means opened only when said lock is opened, while the other end of the assembly is secured by a catch, preferably a magnetic catch to the side of the portfolio.

A further object of the invention is to cover from view the top of a portfolio by providing a cover asembly made of leather which is attached by securing to the inner upper edges of the side, leather panels of the portfolio and within this cover assembly provide the slide fastener or zipper construction which serves as the sole opening means, locked at one end by a hasp and lock assembly and snapped in place by a magnetic fastener at the other end, the cover for the zipper overlying the parting line of the slide elements and having a bevelled corner adjacent the closed position of the slide fastener which prevents the zipper from being caught by the leather cover.

SUMMARY OF THE INVENTION

A leather-lined high quality top-opening leather portfolio is constructed of cowhide left and right side panels which are lined with pigskin suede liner sheets to provide a right pocket extending at the right side of the portfolio to the leather bottom joining the left and right side panels and a left pocket extending to this same bottom. Within each of the left and right panels respectively, apertures are formed at the upper edges to receive the bottom ends of retractible U-shaped leather handles which face each other and which can be pulled up or pushed down through these apertures to carry the portfolio. The bottom of each handle is riveted to an end of a rigid cross strip preferably made of high strength vulcanized fiber board so that when fully retracted the cross strip engages the inner folded edge between the outer cowhide and inner pigskin lining and is retained by said strip at the inner edge.

The central compartment of the portfolio in which the important papers are placed and which are to be secured against unauthorized entry, is covered with the novel unitary assembly of the slide fastener or zipper which is wholly contained within the leather cover. At one end of the cover assembly, which in the illustrated embodiment is the left end, there is provided a downwardly extending tab portion folding over and down the left top portion and the zipper pull is connected to a hasp which engages a slot of a combination lock. The other side of the leather cover, the right side in the illustrated embodiment which contains the end of the zipper or snap fastener is formed in the same tab shape and has embedded at the end of the tab a heavy duty magnetic catch having a pin which engages an opening, to snap into place. The full cover appearance created by the draping of the inner side walls of the leather cover piece obscures a slit opening having a bevelled corner which is located near the left side having the lock. The corner of the bevel is tapered in such a manner that when the hasp is opened and the zipper is pulled over the left top edge, the cover opens up and the zipper pull can be drawn without any likelihood of impediment during the drawing of the zipper from the left side across the top to the right side and down to the snap fastener. In this manner access is gained into the central secure compartment. By reversing the pull the zipper is closed and the hasp inserted into the lock to secure the contents in the central compartment of the portfolio.

In the preferred embodiment two additional pockets are provided, one within the right panel on the right wall of the central secure compartment which is defined within the inner right panel wall and the outer right wall of the secure compartment, while the other pocket is similarly defined on the left panel side within the inner wall of the left panel and the outer left wall of the secure compartment. These outer additional pockets, on left and right sides may occommodate a few flat papers which do not have the importance for security as those papers placed in the central security compartment which is closed by the covered zipper and is secured by the hasp and lock.

Small metal foot members (brass) are fitted and frictionally held at spaced apart locations at the bottom of the portfolio to facilitate standing up the portfolio. Preferably two foot members are provided on the right panel bottom seam and two foot members are provided on the left panel bottom seam. They aid support of the portfolio and are colored in two shades of coloration matching the color of the leather to thereby create a distinctive design.

The outer panels which are constructed of cowhide and form the left and right side panels and are lined with pigskin liner sheets are each provided with a reinforcing vulcanized fiberboard sheet having the same dimensions as the panel and a synthetic polyurethane foam layer is adhesively secured to the inner side of the fiberboard and the inner side of the cowhide outer leather sheet so that the leather is plumped because of the flexible spacing characteristics of the inner synthetic polyurethane foam lining which is adhered to the stiff fiberboard. Effectively the retractable U-shaped leather handles which have riveted ends to the rigid cross strip slide along this smooth fiberboard. The inner pigskin lining is sewn and may be additionally adhesively secured in the bottom portions thereof to the outer cowhide leather panel. The adhesive coating and the sewing or stitching penetrates the inner suede, outer leather, and fiberboard layers to assure that there will be no separation of the reinforcing smooth boundary sheet which serves as the backing for the synthetic foam insulation.

An identification tag is provided for the briefcase and is preferably looped over one of the handles before the handle is assembled in the panel.

A special handle construction may be used and this handle construction is the subject of my copending patent application entitled "Handle and Panel Assembly for Portfolio," Ser. No. 859,483 filed on the same date as the present application now U.S. Pat. No. 4,714,143 granted Dec. 22, 1987.

BRIEF DESCRIPTION OF THE PREFERRED EMBODIMENTS

Figures 1, 2, 3:
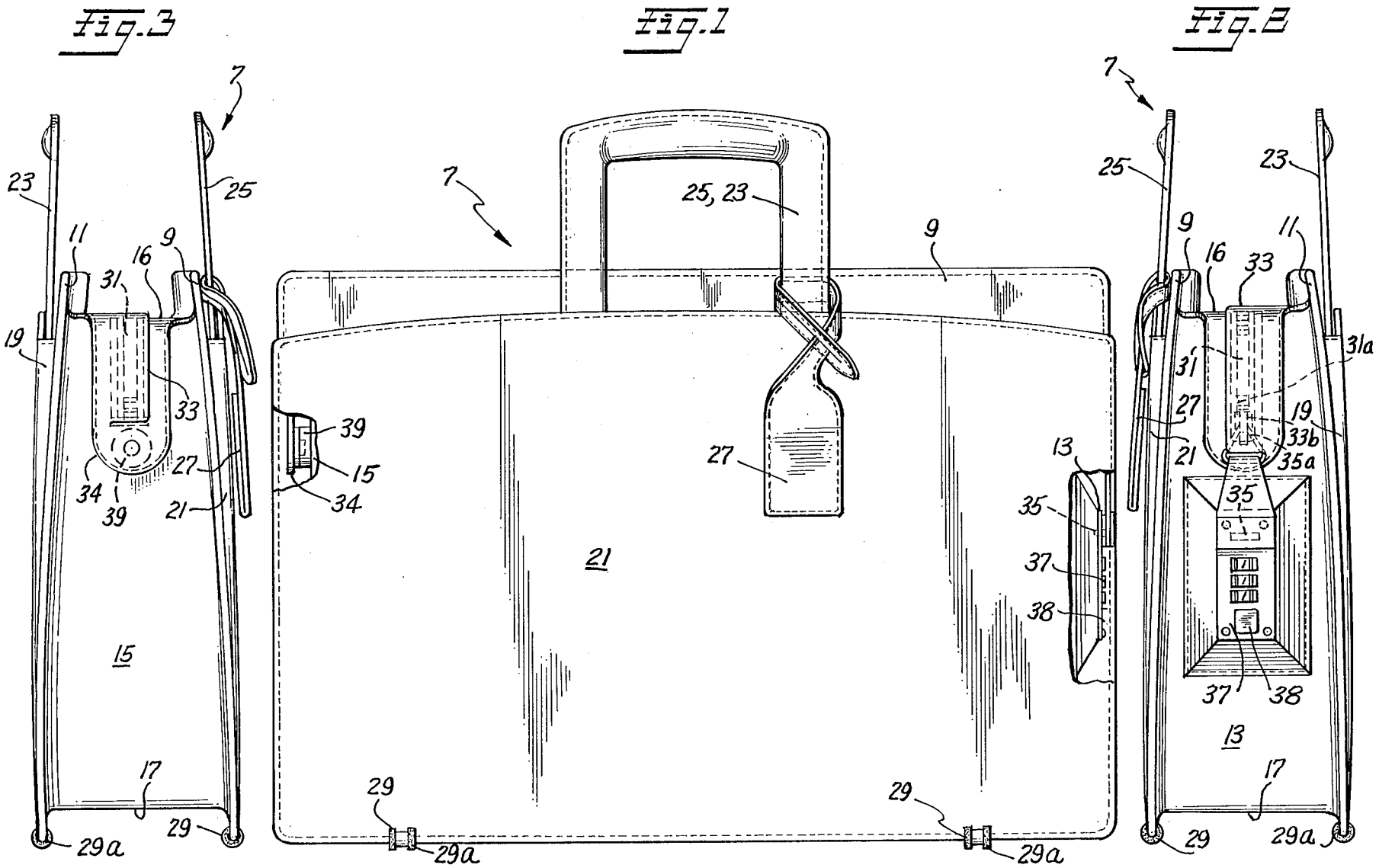
FIG. 1 is a front elevational view of the portfolio of the present invention with sections broken away for illustration.
FIG. 2 is an end view looking from the right of FIG. 1.
FIG. 3 is an end view looking from the left of FIG. 1.
Figure 4:
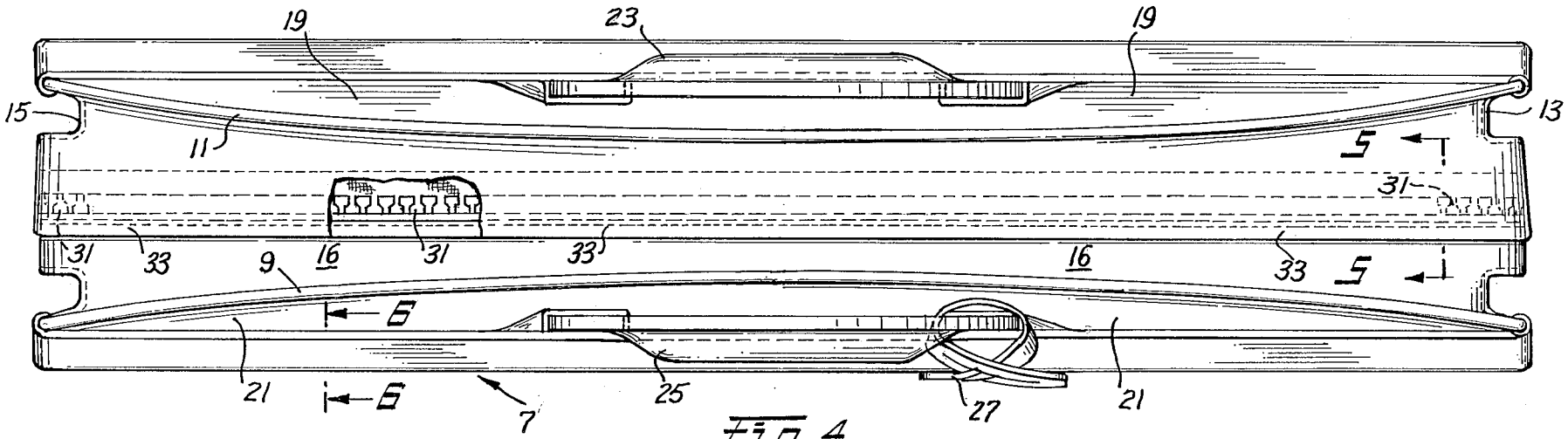
FIG. 4 is an enlarged top view.
Figure 5:
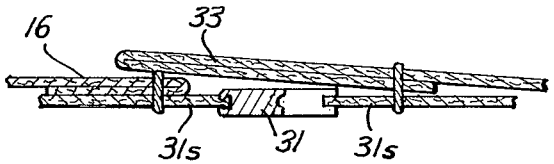
FIG. 5 is an enlarged fragmentary horizontal sectional view through the cover for the zipper.

In the Figs., the portfolio 7 consists of a left side panel 9, a right side panel 11, a left end 15 and a right end 13 with the top 16 and bottom 17 being best shown in FIGS. 2 and 3. The pockets on the left and right sides of the portfolio 7, right pocket 19 and left pocket 21 have their upper edges lying along a line which is generally below the upper edges of the central compartment on the right and left sides, respectively, and this aspect of the portfolio 7 which permits a few additional papers to be inserted into the left and right pockets is conventional.

The handle construction of the left handle 25 and the right handle 23 which is shown in the present drawings and described herein is the subject matter of my copending application entitled "Handle and Panel Assembly for Portfolio", Ser. No. 859,483 which is filed on even date herewith now U.S. Pat. No. 4,714,143 granted Dec. 22, 1987, but conventional handles may be used. By conventional handles is meant a sewn handle which is generally sewn on both the interior edge of the U-shape and the exterior edge of the U-shape to make a double line of stitching on the outside of the handle without any special provision being made to shape the top cross portion of the handle where it is grasped by the fingers or by the hand of the person carrying the portfolio. The conventional construction of the handle places it within the outer wall construction of the central compartment, namely: the compartment which is secured by the zipper 31 underlying the zipper cover of leather 33, and which zipper 31 is formed of elongated strips 31s extending over the entire top of the center compartment and downwardly on each side of the portfolio to end at one side at the snap fastener 39 and at the other side at the lock 37. Thus the zipper strip **31*s* and elements are connected to hasp 35 which engages into the lock mechanism provided by the combination lock 37. The zipper pull member 31*a* is connected to the hasp 35 by means of a connecting triangular member 35*a* which is part of the hasp 35. The upper end of triangular member 35*a* is held within loop member 33*b* of the zipper pull member 31*a* as shown in FIG. 2. The triangular member 35*a* and the loop member 33*b* underlie the ends of the strips and are thereby concealed. Thus the zipper pull member 31*a* operates to open the central compartment at the top but is nevertheless covered, that is to say, zipper 31 is covered by the leather zipper cover 33 which is formed with the rounded end 34 of the zipper cover to prevent any entanglement of the zipper cover in the slide fastener elements of zipper 31. The secure central compartment is accessible only from the top 16 of the portfolio 7. The left end 15 of the portfolio 7 has the other end of the zipper 31 and the zipper cover 33 connected to the side 15 by means of a magnetic snap fastener 39. The magnetic snap fastener 39 is shown in face view in FIG. 3 and in broken away inset in FIG. 1 at the left side of the Fig. Similarly, the hasp 35 and combination lock 37 is shown in FIG. 2 at the right side of the bag and in FIG. 1 in a broken insert across from the face view of FIG. 2**.

The hasp 35 of the combination lock 37 is released when the correct combination of the lock has been dialed and the latch 38 is actuated.

As shown in FIG. 1 a conventional identification tag 27, preferably made of leather, is hooked around one handle and in the view shown, the left handle 25. Obviously the tag 27 can be hooked around the other handle. Both left and right handles 25 and 23 are of the retractable type and slide in the space provided for the reciprocating movement of these handles against an inner wall of the edge panel, left panel 9 and right panel 11, in a manner so that when fully retracted each handle having a cross piece at the bottom (not shown) comes into engagement of this cross piece with the inner sewn edge at the top edge of the right and left panels 11 and 9 respectively.

Figure 6:
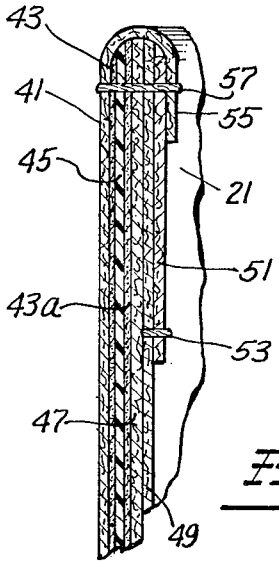
FIG. 6 is an enlarged vertical sectional view through the wall of a pocket showing the foam liner between the outside wall of the pocket and the fiberboard stiffener used as a reinforcing backing taken along line 6—6 of FIG. 4.

The side panels 9 and 11 of the present invention have certain novel and patentable features of construction, namely, as shown in FIG. 6, each rectangular side panel 9 and 11 consists of a laminated construction comprising an outside rectangular wall 41 of the pocket which is made of leather adhesively secured by adhesive 43 to a polyurethane foam liner 45 which liner 45 is secured on its opposite face to the rectangular stiff fiberboard reinforcement panel or sheet 47 by adhesive **43*a* and the panel 47 is covered by the suede or pigskin lining 49 which provides the other liing attached by sewing to the outside leather wall, preferably made of cowhide. This attachment of the outer cowhide wall 41 to the inner suede pigskin lining 49 is by means of stitches 53. A reinforcing leather strip 51 is also secured to the inner suede pigskin lining 49 by through stitches 57 and stitches 53. The stitches are sewn with a high quality bonded waterproof thread and the same thread is used in the particularly peferred embodiment of the present invention for making a hem 55 to finish off sewing attachment and to improve the appearance. Note that the joining of the inner leather lining 49 and outer wall panel 41 is assured through upper stitches 57 and hemming stitches 55 which cooperate in providing a neat appearance with no possibility of mechanically creating a parting edge which would tend toward separation of the wall 41 from lining 49. The appearance thus provides a trim edge and a highly tailored look both at the upper sewing line of stitches 57 and at the low hem sewing line of stitches 53**.

Finally, the choice of tanned leather and the selection of high quality aniline dyes in providing the various colord and shades in brown, red, maroon, tan, etc., is coordinated to provide matching color and to impart a soft feel or touch to the leather exterior surfaces of the portfolio 7 including the surfaces of the handles 23 and 25, the left and right side panels 9 and 11 and the left and right ends 15 and 13. The softness of the sides is enhanced in a very significant manner due to the plumping action of the underlying polyurethane foam liner 45. This softness is very distinctively felt by the user of the portfolio and by the sense of touch one may readily indentify the product of the present invention. It matches the softness of a soft pigskin or calfskin purse, yet combines the ruggedness and serviceability of a very heavy leather portfolio because of the selection of high quality leather materials and their careful construction using water resistant adhesive and stitching threads.

Four foot members 29 which support the portfolio 7 at the bottom edge are provided as shown in FIGS. 1—3. These foot members 29 are spaced apart at the bottom so as to raise the portfolio 7 off the floor and prevent the leather bottom edge from being wetted if set down on a moist floor. These foot members 29 are in the form of barrel shaped metal elements, preferably aluminum or brass, and are each provided with an opening to enclose the lower sewn edge of each of the panels at the left and right sides 9 and 11, respectively to constitute the mechanical supporting means, and also to provide a decorative effect because the metal is colored. The brass color contrasts with the brown color of the lateral panel. Anodized aluminum colors may be used. Two-tone colors may be used to enhance the decorative effect, e.g. the edges of the barrel at the left and right sides are stippled at **29*a* to show contrasting colors, and a deeper brass, e.g. redder and the central portion of the foot element 29** may be colored more yellow, both colors contrast with the deep brown color of the leather. Similarly different colors on aluminum foot members may be used.

Having thus disclosed the invention, what is claimed is:

1. In a leather portfolio having generally rectangular side panels, a closed bottom, closed end, a lock embedded in one end and an open top which defines a security compartment for holding papers which are to be guarded against unauthorized entry, that improvement consisting of:

a unitary three piece combination of a sewn-together zipper assembly, a leather zipper cover and a locking hasp which unitary combination is additionally sewn between the inner upper edges of said side panels of said leather portfolio;

said zipper assembly comprising two rows of interlocking slide fastener elements, a pull member with said locking hasp for engaging said lock at said one end, a tongue fastened to the other end and a leather strip adjoining each of the rows of fastener elements and each strip being sewn to a respective side panel;

said leather strip adjoining each of the fastener elements and the cover for the zipper assembly extending along the entire top of the security compartment and extending downwardly at the ends on each side of the portfolio to terminate on said one end at the lock and at a fastener at the other end of said portfolio, said cover at the lock end of said portfolio concealing from view the connection between the lock and the zipper assembly;

said hasp being attached to the pull member of said zipper assembly by means of a loop member connecting an end of said hasp to the pull member of said zipper assembly;

said leather zipper cover being sewn to one of said side panels with an edge thereof remote from the sewn edge overlying the slide fastener elements to project only slightly beyond the far edge of said slide fastener elements to thereby hide the slide fastener elements from view;

the strips of said zipper assembly which are sewn to both side panels and the zipper cover sewn to one of said side panels being of the same material as said side panels to provide the appearance at the top of the portfolio of a unitary cover matching the sdes of the portfolio with no visual indication of opening mens viewed from the top;

the pull member of said zipper assembly constituting the sole means of opening and thereby entering the central compartment of said portfolio after the lock hasp is detached from said lock to pull the zipper fastener elements open starting from the end where the lock is located to the other opposite end at the tongue where the tongue is fastened to said other end and said tongue being fastened to said other end of said leather portfolio with a snap fastener and wherein said side panels, ends, bottom and zipper cover of said portfolio are constructed of leather.

2. A portfolio as claimed in claim 1 wherein foot members are frictionally fitted to support the bottom edge of each of said side panels, there being two foot members on each side.

3. A portfolio as claimed in claim 2 wherein said foot members are made of metal.

4. A portfolio as claimed in claim 3 wherein said foot members are made of brass.

5. A portfolio as claimed in claim 3 wherein said foot members are made of aluminum.

6. A portfolio as claimed in claim 4 where said brass foot member is barrel shaped having outer portions in a color resembling copper and an inner portion in a color resembling yellow brass.

* * * * *